United States Patent [19]

Bigot et al.

[11] Patent Number: 4,699,332

[45] Date of Patent: Oct. 13, 1987

[54] DEVICE FOR MEASURING THE HEADING ERROR OF A MISSILE

[75] Inventors: Georges Bigot, St. Julien l'Ars; Jacques J. Lonnoy, Paris, both of France

[73] Assignee: Societe Anonyme de Telecommunications, Paris, France

[21] Appl. No.: 732,643

[22] Filed: May 10, 1985

[30] Foreign Application Priority Data

May 17, 1984 [FR] France ..... 84 07633

[51] Int. Cl.[4] ..... F41G 7/26

[52] U.S. Cl. ..... 244/3.11; 244/3.16

[58] Field of Search ..... 244/3.11, 3.15, 3.16; 356/152; 250/342

[56] References Cited

U.S. PATENT DOCUMENTS

| | | | |
|---|---|---|---|
| 4,028,544 | 6/1977 | Jourdan et al. | 244/3.16 |
| 4,038,547 | 7/1977 | Hoesterey | 244/3.11 |
| 4,244,540 | 1/1981 | Vollmerhausen | 244/3.16 |
| 4,286,760 | 9/1981 | Coudere et al. | 244/3.16 |

FOREIGN PATENT DOCUMENTS

| | | | |
|---|---|---|---|
| 54353 | 6/1982 | European Pat. Off. . | |
| 2547650 | 12/1984 | France | 244/3.11 |
| 1596543 | 8/1981 | United Kingdom | 244/3.11 |

*Primary Examiner*—Deborah L. Kyle
*Assistant Examiner*—Michael J. Carone
*Attorney, Agent, or Firm*—Jacobs & Jacobs

[57] ABSTRACT

A device for measuring the heading error of a missile, comprising two afocal systems for a taking-in-charge field PC and a cruising field CR, in front of a double prism, with a central prism and a peripheral prism of the same angle bonded together with their dihedrals opposed. The double prism is in front of a focusing lens in the focal plane of which are disposed four detectors. When one detector sees the PC field, the other detector sees the CR field. An analog switch permutes in a circular fashion a processing device to the PC channel or the CR channel, for delivering missile heading error measurement signals.

14 Claims, 4 Drawing Figures

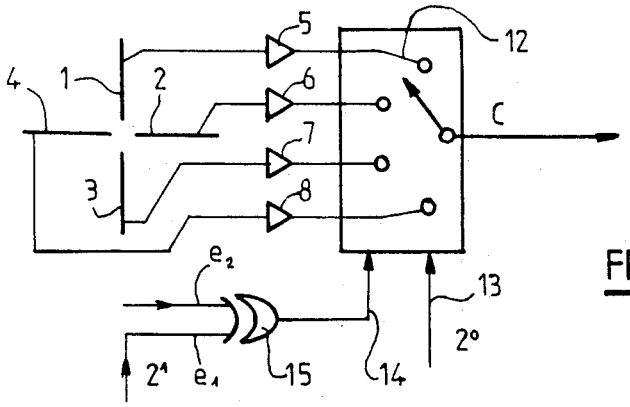
FIG. 2
FIG 3
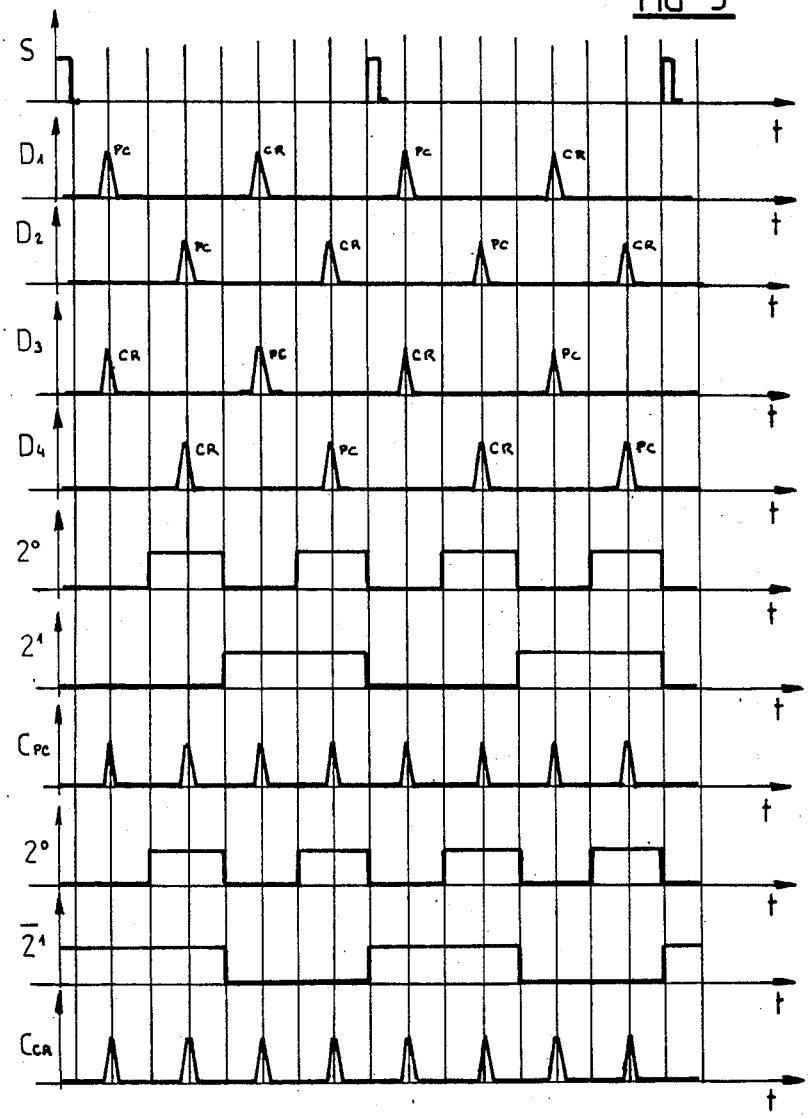

DEVICE FOR MEASURING THE HEADING ERROR OF A MISSILE

BACKGROUND OF THE INVENTION

1. Field of the Invention

The present invention relates to a device for measuring the heading error or a missile, comprising a focusing lens, an array of detectors placed in the focal plane of the lens, a device for sequentially analyzing the field of observation, a processing device adapted for delivering, from the signal supplied by the detectors, signals representative of the coordinates of the missile.

2. Description of the Prior Art

In practice, the focusing lens and the device for analyzing the field of observation are integrated in an optronic box. This box receives the infrared radiation emitted for example by the pyrotechnic tracers fixed to the rear of the missile and focuses it on the detectors. The device for analyzing the field of observation is formed by an opto-mechanical system generally comprising at least two prisms, as will be seen further on, rotated mechanically for driving the image of the instantaneous field of the device, and the missiel-source with it, in relative circular translation with respect to the detectors and thus cause scanning thereof by the missile-source. As for the processing device or case, from a time reference, it allows the passage times of the missile over the detecting means during scanning thereof to be calculated, the angular then metric measurement of the heading error of the missile with respect to a siting axis to be determined and different anti-decoy treatments to be effected. The measurement of the heading error of the missile is then transmitted to an electronic guidance circuit which deduces therefrom the corrections to be made to the steering controls of the missile for bringing it back to the siting line.

It should be noted here that the invention applies to heading error measurement devices of the cruciform type and, more generally to heading error measurement devices with sampling or sequential scanning.

The infrared heading error measurement devices used for guiding missiles require at least two, even three fields of observation with as many optical and detection systems, namely a large field on firing for taking charge (PC) and rapid acquisition of the missiles, an intermediate field, not always used it is true, for guiding during the first part of the trajectory and a small field, called cruising field (CR), for accurate guiding of the missiles until they impact on the target.

In these heading error measurement devices, and only considering the PC and CR fields, the equipment is therefore doubled: two detector arrays, sometimes two cryostats and two preamplifier chains; often two mechanisms for rotating the scanning prisms, respectively for the PC channel and the CR channel which raises a problem of synchronization between these two channels, resolved up to now by using two sets of gears, but to the detriment of the accuracy.

Furthermore, an electric circuit must be provided for switching the data relative to the PC-CR fields.

These are drawbacks which the present invention aims at eliminating.

To resolve his problem, the applicant has taken as basis the fact that, for example in a heading error measuring device with filiform detectors disposed in a cross, split up or not, with one cross or two crosses, for improving the anti-decoy characteristic, the detectors are used for only a part of the time.

SUMMARY OF THE INVENTION

The present invention provides then a device for measuring the heading error of a missile of the above mentioned type, comprising means adapted for simultaneously associating at least two detectors with two different fields of observation, respectively.

Thus, with this invention, a single array of detectors may be used since, when a detector sees a first field, for example the PC field, another detector sees simultaneously the CR field; the device of the invention no longer comprises an electric switching circuit properly speaking and only comprises a mechanical rotation means: for a given cruising accuracy, the accuracy of taking in charge is improved thereby.

In the preferred embodiment of the device of the invention, said association means comprises a first peripheral prism and a second central prism, having the same angle at the apex as the first one, the two prisms being disposed with their dihedrals opposed.

In this case, the CR channel may be assigned equally well to the peripheral prism or to the central prism and the PC channel to the other.

BRIEF DESCRIPTION OF THE DRAWINGS

The invention will be better understood from the following description of several embodiments of the device of the invention, with reference to the accompanying drawings in which:

FIG. 2 shows the electronic data acquisition part of the optronic box of the device of the invention;

FIG. 3 shows the chronogram of the signals present in the electronic part of FIG. 2.

DESCRIPTION OF THE PREFERRED EMBODIMENTS

Figure 1:
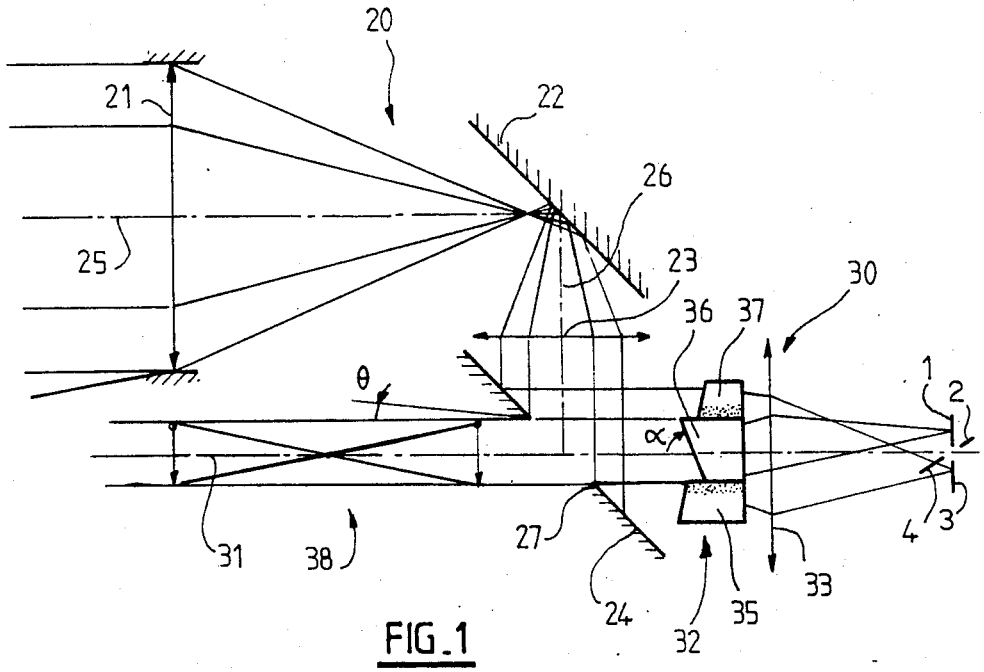
FIG. 1 shows schematically a first embodiment of the optical part of the optronic box of the device of the invention.

FIG. 1 shows a first embodiment of the heading error measuring device in the case considered with four filiform detectors 1, 2, 3, 4 in the form of a cross disposed at 90° from each other.

The infrared radiation emitted by the traces of the missile is received on the optical part of an optronic box, and which comprises an afocal system 20, with magnification G, and a convergent system 30, with respective parallel axes 25, 31. The afocal system 20 comprises an input lens 21 with axis 25, a mirror 22 slanted at 45° with respect to this axis, an output lens, disposed orthogonally to the first one and reflecting a beam parallel to its axis 26 on an annular mirror 24, slanted at 225° with respect to the axes of the systems and pierced with an elliptic orifice 27 centered on the axis 26 of lens 23 and the axis 31 of the convergent system 30. Mirror 24 reflects an annular beam on the convergent system 30. With preferably an afocal system 38, with magnification 1, in front of orifice 27 of mirro 24, the convergent system 30 comprises a double prism 32, followed by a convergent lens 33 with axis 31, called focusing lens, in the focal plane of which are disposed the detectors 1–4.

The double prism 32 in fact comprises a first peripheral prism 35 and a second central prism 36, bonded to each other, the bonding agent forming an annular dead zone 37. They have the same angle at the apex, but their dihedrals are opposed. In other words, their lines of greatest slope are slanted with respect to axis 31 in opposite directions, one, that of the central prism by an angle $\alpha$, the other, that of the peripheral prism, by an angle $(360° - \alpha)$. One face of the dihedron of the central prism and the other face of the dihedron of the peripheral prism are coplanar and perpendicular to axis 31. Again in other words, the two prisms 35, 36 are offset angularly with respect to each other by an angle $\pi$ about the axis 31.

The angle of the field $\theta$ of the convergent system is defined by the dimensions of the detectors and of the elements of the convergent system 30. The field angle of the afocal system is $\theta/G$.

In the example shown in FIG. 1, the taking in charge channel PC is the central channel, and the cruising channel CR is the annular channel.

The orifice 27 of mirror 24 and the dead zone 37 of the double prism 32 have mutually related dimensions. The central channel has an output pupil corresponding to the outer diameter $\phi_1$ of prism 36. As for the CR channel, lens 21 forms its input pupil and it participates, with zone 37 of the double prism 32, in the definition of its annular output pupil of outer diameter $\phi_{2ext}$ and with inner diameter $\phi_{2int}$.

On the area of these output pupils depends the amplitude of the signals received on the detectors, namely:

$$S_{PC} = \frac{\pi\phi_1^2}{4}$$

$$S_{CR} = \frac{C^2\pi(\phi_{2ext}^2 - \phi_{2int}^2)}{4}$$

As can be readily seen in FIG. 1, especially during the cruising phase of the trajectory of the missile when detector 1 sees the field PC, detector 3 sees the field CR and conversely when detector 1 sees field CR, detector 3 sees the field PC. The same goes for detectors 2, 4.

Let us turn now to the electronic data acquisition portion of the optronic box.

On firing, since the trajectory of the missile is not stabilized, only the PC channel is used. In this case, the detectors see the missile in turn.

Beyond the taking in charge, and during cruising, the two channels may be used since if the missile is in the cruising field $\theta/G$, it is a fortiori in the taking in charge field $\theta$. In this case, and assuming that detector 1 is at a given moment used for taking in charge, i.e. $\mathbf{1}_{PC}$, on a chronogram we will have successively:

$\mathbf{1}_{PC}$ and $\mathbf{3}_{CR}$
$\mathbf{2}_{PC}$ and $\mathbf{4}_{CR}$
$\mathbf{3}_{PC}$ and $\mathbf{1}_{CR}$
$\mathbf{4}_{PC}$ and $\mathbf{2}_{CR}$ Thus it can be seen that for going over from the PC channel to the CR channel, the processing device has only to effect a circular permutation of the detector numbers from (1, 2, 3, 4) to (3, 4, 1, 2).

Let us see now how that occurs in practice.

The circular translation of the instantaneous observation field is achieved here by means of the double prism 32, supported by a rotary turret 39 housed in a fixed mount. For delivering a heading error measurement, the position of the prism at the moments when the image of the source during scanning thereof meets the detectors must be known accurately. For this, there is associated with the turret 39 of the prism a coded wheel with two tracks, intended to be read by an optoelectronic device, and one of which comprises a single transparent sector giving the zero position of the prism, and which is called synchro-revolution and the other of which comprises, in number depending on the desired accuracy, alternately opaque and transparent sectors delivering after reading a train of pulses at a given frequency, then multiplied by an appropriate number for obtaining a clock signal. When the image of the source meets a detector, the count of the clock pulses following the pulse of the synchro-revolution supplies the angular position of the prism, i.e. the angular heading error measurement from the source.

The four detectors 1–4 (or 0–3) are connected respectively to four preamplifiers 5–8 connected to the inputs of an analog multiplexer 12 illustrated by a switch, which has nothing to do with an electric switch, whose output C is connected to the input of the processing device (FIG. 1).

Let us consider the chronogram of FIG. 3.

We saw that when detector 1 was used for PC, detector 3 was used for CR, when detector 2 was used for PC, detector 4 was used for CR, etc . . . . Let S then be the signal of the synchro-revolution, the time interval between two pulses representing a scanning period and a revolution of the prism, $D_1$–$D_4$ the output signals from the four detectors. At the output of each detector alternating PC and CR pulses are emitted successively.

If it is desired to collect at the output C of multiplexer 12 the series of pulses $C_{PC}$ of the PC channel, the multiplexer 12 must be controlled at two inputs 13, 14 respectively by binary signals $2^0$ and $2^1$ representative respectively of the first digits 0101 and of the second digits 0011 of numbers in binary numbering, in which the decimal digits 0, 1, 2, 3 are written 00, 01, 10 and 11. Here, the series 0, 1, 2, 3 is identified with the series 1, 2, 3, 4. It is a question for $2^0$ of a balanced rectangular signal of period equal to half the scanning period, and for $2^1$ of a balanced rectangular signal of period equal to the scanning period.

In fact, in a scanning period considered, during emission of pulse $\mathbf{1}_{PC}$, the input $2^0$ is at state 0 and the input $2^1$ at state 0, representing the first binary number, 0, during the emission of pulse $\mathbf{2}_{PC}$, the input $2^0$ is at state 1 and the input $2^1$ at state 0, representing the second binary number, 1, during the emission of pulse $\mathbf{3}_{PC}$, the input $2^0$ is at state 0 and the input $2^1$ at state 1, representing the third binary number, 10, and during the emission of the pulse $\mathbf{4}_{PC}$, the input $2^0$ is at state 1 and the input $2^1$ at state 1, representing the fourth binary number 11.

It goes without saying that the number 4 of detectors is not limitative and that beyond this number the multiplexer should have a number of control inputs equal to the number of digits of the binary number corresponding to the number of detectors.

If it is desired to collect at the output C of multiplexer 12 the series of pulses $C_{CR}$ of the CR channel ($\mathbf{3}_{CR}$,$\mathbf{4}_{CR}$,$\mathbf{2}_{CR}$,$\mathbf{1}_{CR}$), the multiplexer must be controlled at its two inputs 13, 14 respectively by the binary signal $2^0$ and the binary signal $\overline{2^1}$ the inverse of signal $2^1$.

Thus, switching to one or other of the PC and CR channels is provided by an exclusive OR gate 15, connected to the control input 14 of multiplexer 12. On the initiative of the processing circuit, gate 15 receives at one of its inputs the signal $2^1$ and at the other of its inputs a signal 0, for the PC channel, and a signal 1, for the CR channel.

In fact, the table of truth of an exclusive OR gate is the following, $e_1$ and $e_2$ representing the states of the two inputs of the gate:

| $e_1$ | $e_2$ | Exclusive OR |
|---|---|---|
| 0 | 0 | 0 |
| 1 | 1 | 1 that is $e_2$ |
| 1 | 0 | 1 |
| 1 | 1 | 0 that is $\overline{e_2}$ |

When the input $e_2$ is at state 0, the output of the gate reproduces the input $e_1$, i.e. $2^1$, when the input $e_2$ is at state 1, the output of the gate reproduces the inverse of the input $e_1$, i.e. $2^1$.

A heading error measurement device has been described up to now having four filiform detectors disposed in a cross, with means for associating the two PC and CR fields and detectors, considered two by two and, in this case the pairs of detectors (1, 3) and (2, 4) comprising two prisms with equal dihedrals and staggered by the axis of the convergent lens. It is not a question of limitative characteristics. The pairs (1, 2) and (3, 4) or (1, 4) and (2, 3) could be considered. Similarly, the equal dihedral prisms could be staggered about the axis of the convergent lens by another angle for example $\pi/2$ or $3\pi/2$. The heading error measuring device could comprise less than four detectors, for example two, disposed at 90° from each other or not or more, with for example an array of four detectors each, inserted between each other.

Finally, the function of the two prisms, one central and the other peripheral, having the same angle at the apex is to generate two different deflections and, in the case considered, of equal amplitudes in opposite directions of an incident beam. Such a function could also be provided by a double rotary mirror. The solution of the double prism is preferred.

Moreover, when the missile is almost centered and is almost on the optical axis of the system, at the output of the detectors, the pulses are emitted at substantially regular intervals, as shown in FIG. 3. In actual fact, it is only a question here of a border line case. In fact, though there is only a single field in the object space, just in front of the convergent system 30 but after the afocal system 20, in channel CR there are two different rotary fields whose sources do not necessarily meet the opposite detectors of the same pair of detectors at the same moments. In other words, in the image space, there are two sources rotating about two circles of the same diameter but off-centered differently, respectively centered at $C_{PC}$ and $C_{CR}$, according to the following formula, where O is the center of the four detectors disposed in a cross;

$$OC_{CR}/OC_{CP}=|G|$$

Figure 4:
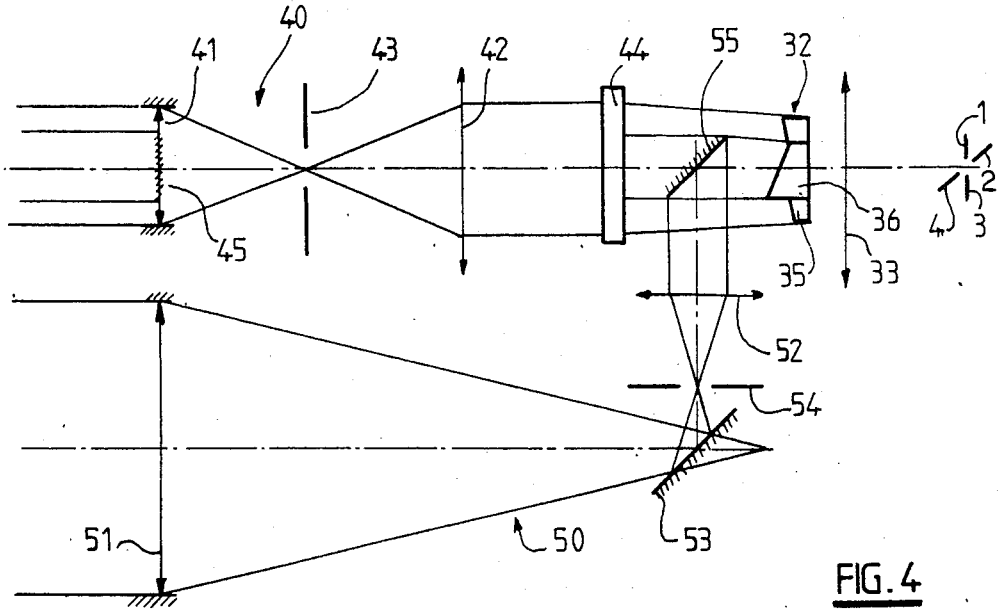
FIG. 4 shows schematically a second embodiment of the optical part of the optronic box of the device of the invention.

In the embodiment shown in FIG. 1, the PC channel is the central channel and the CR channel is the peripheral channel. It has already been stated that these channels could be inverted and, in fact, it is preferable to do so, as in the case of the embodiment shown in FIG. 4. In this case, there are still provided the double prism 32 and the convergent output lens 33 in the focal plane of which the detectors are disposed. But the PC channel is peripheral and passes through the peripheral prism 35. It comprises, from the input to the output, an afocal system 40, with here a magnification of −1, comprising an input lens 41 and an output lens 42, in the focal plane of which is disposed a field diaphragm 43 corresponding to the angle of field PC, the afocal system 40 being followed by a mirror with parallel faces 44. The input pupil of the PC channel is formed by lens 41 and a central shutter 45, and its output pupil is formed by the peripheral prism 35.

The CR channel comprises, from the input to the output, an afocal system comprising an input lens 51 and an output lens 52, orthogonal to lens 51 and, in the path of the beam between these two lenses, a mirror 53 slanted at 45° with respect to the axis of lens 52 and, in its focal plane, a field diaphragm 54 corresponding to the aperture angle of the field CR, the afocal system 50 being followed by a mirror 55 slanted at 225° with respect to the axis of lens 52 for reflecting the beam on to the central prism 36. The input pupil of the CR channel is formed by lens 51 and its output pupil is formed by the central prism 36.

With the interpositioning of the field diaphragms 43 and 54, the image fields in the plane of the detectors are strictly limited to the PC and CR fields, whereby the parasites are eliminated. In addition, when the missile is within the CR field, and when the two channels deliver pulses, whereas this in only useful for cruising, the PC pulses may be eliminated by means of a PC field diaphragm with annular aperture, having an internal diameter and an external diameter corresponding respectively to the CR and PC fields.

What is claimed is:

1. A device for measuring the heading error of a missile, comprising a focusing lens, an array of detectors placed in the focal plane of the lens, a device for sequentially scanning the field of observation, a processing device adapted for delivering, from the signals supplied by the detectors, signals representative of the coordinates of the missile, and means adapted for simultaneously associating at least two detectors with two different fields of observation, respectively.

2. The device as claimed in claim 1, wherein said association means comprise means adapted for generating two different deflections of an incident beam.

3. The device as claimed in claim 1, wherein said array of detectors comprises four detectors disposed in the form of a cross at 90° from each other.

4. The device as claimed in claim 1, wherein said detectors are connected to the inputs of an analog multiplexer whose output is connected to said processing device, said multiplexer comprising two control inputs, one of which is connected to the output of an exclusive OR gate.

5. The device as claimed in claim 2, wherein said means adapted for generating two different deflections are disposed in front of said focusing lens.

6. The device as claimed in claim 2, wherein said association means comprise at least one afocal system in front of said means adapted for generating two different deflections.

7. A device for measuring the heading error of a missile, comprising a focusing lens, an array of detectors placed in the focal plane of the lens, a device for sequentially scanning the field of observation, a processing device adapted for delivering, from the signals supplied by the detectors, signals representative of the coordinates of the missile, and means adapted for simultaneously associating at least two detectors with two different fields of observation, respectively, said association means including a first peripheral prism and a second central prism, with the same angle at the apex, said prisms being disposed with their respective dihedrals staggered angularly about the axis of said focusing lens, said prisms providing means for generating two different deflections of an incident beam.

8. The device as claimed in claim 7, wherein the dihedrals of said two peripheral and central prisms are staggered by an angle $\pi$.

9. The device as claimed in claim 7, wherein said array of detectors comprises four detectors disposed in the form of a cross at 90° from each other.

10. The device as claimed in claim 7, wherein said detectors are connected to the inputs of an analog multiplexer whose output is connected to said processing device, said multiplexer comprising two control inputs, one of which is connected to the output of an exclusive OR gate.

11. A device for measuring the heading error of a missile, comprising a focusing lens, an array of detectors placed in the focal plane of the lens, a device for sequentially scanning the field of observation, a processing device adapted for delivering, from the signals supplied by the detectors, signals representative of the coordinates of the missile, and means adapted for simultaneously associating at least two detectors with two different fields of observation, respectively, said association means comprising means for generating two different deflections of an incident beam and a mirror pierced with an elliptic orifice centered on the axis of said focusing lens and disposed in front of said means for generating two different deflections.

12. The device as claimed in claim 11, wherein said association means comprise two afocal systems disposed in front of said means adapted for generating two different deflections, and each provided with a field diaphragm.

13. The device as claimed in claim 11, wherein said array of detectors comprises four detectors disposed in the form of a cross at 90° from each other.

14. The device as claimed in claim 11, wherein said detectors are connected to the inputs of an analog multiplexer whose output is connected to said processing device, said multiplexer comprising two control inputs, one of which is connected to the output of an exclusive OR gate.

* * * * *